US009201323B2

(12) United States Patent
Nishikawa et al.

(10) Patent No.: US 9,201,323 B2
(45) Date of Patent: Dec. 1, 2015

(54) TONER

(71) Applicant: CANON KABUSHIKI KAISHA, Tokyo (JP)

(72) Inventors: Koji Nishikawa, Susono (JP); Katsuhisa Yamazaki, Numazu (JP); Daisuke Yoshiba, Suntou-gun (JP); Shotaro Nomura, Suntou-gun (JP); Hiroki Akiyama, Toride (JP); Masami Fujimoto, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/341,084

(22) Filed: Jul. 25, 2014

(65) Prior Publication Data

US 2015/0037723 A1 Feb. 5, 2015

(30) Foreign Application Priority Data

Jul. 31, 2013 (JP) ..... 2013-158908

(51) Int. Cl.
*G03G 9/08* (2006.01)
*G03G 9/087* (2006.01)

(52) U.S. Cl.
CPC ..... *G03G 9/0825* (2013.01); *G03G 9/0819* (2013.01); *G03G 9/08755* (2013.01)

(58) Field of Classification Search
CPC ..... G03G 9/08797; G03G 9/08755; G03G 9/0819; G03G 9/09708; G03G 9/09716; G03G 9/09725
See application file for complete search history.

(56) References Cited

U.S. PATENT DOCUMENTS 8,389,188 B2 3/2013 Kim et al.

FOREIGN PATENT DOCUMENTS

| | | | |
|---|---|---|---|
| JP | 2011-2653 | A | 1/2011 |
| JP | 2011-501231 | A | 1/2011 |
| WO | 2013/063291 | A1 | 5/2013 |

OTHER PUBLICATIONS

U.S. Appl. No. 14/339,689, filed Jul. 24, 2014. Applicant: Nomura, et al.
U.S. Appl. No. 14/446,286, filed Jul. 29, 2014. Applicant: Naka, et al.

*Primary Examiner* — Hoa V Le
(74) *Attorney, Agent, or Firm* — Fitzpatrick, Cella, Harper and Scinto

(57) ABSTRACT

A toner excellent in end-portion hot offset properties is provided. A toner including toner particles and an external additive, wherein the toner particles contain a binder resin, and organic-inorganic composite fine particles dispersed in the binder resin, and the organic-inorganic composite fine particles (1) have a number-average particle diameter of 70 nm or more and 500 nm or less, (2) have a structure in which inorganic fine particles are embedded in a resin particle, convexes derived from the inorganic fine particles being present on surfaces of the organic-inorganic composite fine particles, (3) have a shape factor SF-2 of 103 or more and 120 or less, and (4) contain a resin component in which a proportion of THF-insoluble matter based on a mass of the resin component is 95% by mass or more.

2 Claims, No Drawings

TONER

BACKGROUND OF THE INVENTION

1. Field of the Invention

The present invention relates to a toner for use in an image forming method such as an electrophotographic method.

2. Description of the Related Art

Image forming apparatuses using an electrophotographic method, such as printers and copiers, are demanded to achieve further speeding up and energy saving, and it is effective for achieving speeding up and energy saving to enhance the low-temperature fixability of a toner. On the other hand, printers and copiers have been used for various purposes in recent years, and have been increasingly performing output on various sizes of paper sheets frequently. On the other hand, problems along therewith have been easily caused.

For example, when small-sized paper sheets are continuously fed to a fixing unit and then larger-sized paper sheets than the small-sized paper sheets are fed thereto, the following problem occurs: the small-sized paper sheets are continuously fed to thereby result in the increase in temperature of an area of the fixing unit, through which no paper sheets are allowed to pass, easily causing so-called end-portion hot (or high temperature) offset to occur.

Even if the low-temperature fixability of a toner can be enhanced to allow the preset temperature of a fixing unit to be lower than the preset temperature of a conventional unit, the increase in temperature of the end portion of the fixing unit cannot be avoided in continuous feeding of the small-sized paper sheets, and hence it is also important to enhance the hot offset resistance of a toner. In order to satisfy the hot offset resistance, various toners have been proposed.

In Japanese Patent Application Laid-Open No. 2011-501231, a toner into which a crosslinkable resin is incorporated for improvement in the hot offset has been proposed. In Japanese Patent Application Laid-Open No. 2011-002653, a toner into which resin particles having a softening temperature higher than the softening temperature of a binder resin is incorporated has been proposed. Both of the documents, however, can be insufficient in terms of the hot offset resistance with an end portion focused.

SUMMARY OF THE INVENTION

As described above, an object of the present invention is to provide a toner excellent in end-portion hot offset properties.

The present invention relates to a toner including toner particles and an external additive, wherein each of the toner particles contains a binder resin, and organic-inorganic composite fine particles each of which contains a resin particle and inorganic fine particles, the organic-inorganic composite fine particles being dispersed in the binder resin, and the organic-inorganic composite fine particles (1) have a number-average particle diameter of 70 nm or more and 500 nm or less, (2) have a structure of which the inorganic fine particles are embedded in the resin particle, and have convexes derived from the inorganic fine particles on surfaces of the respective organic-inorganic composite fine particles, (3) have a shape factor SF-2 of 103 or more and 120 or less, and (4) contain a resin component in which a proportion of THF-insoluble matter based on a mass of the resin component is 95% by mass or more.

The present invention can provide a toner in which the occurrence of end-portion hot offset is suppressed.

Further features of the present invention will become apparent from the following description of exemplary embodiments.

DESCRIPTION OF THE EMBODIMENTS

Preferred embodiments of the present invention will now be described in detail.

First, end-portion offset as the problem of the present invention is studied. It is considered that a toner is in an almost molten state at a fixing unit temperature at which end-portion hot offset may occur. The present inventors have considered that if the reduction in viscosity of a toner can be suppressed even at such a fixing unit temperature at which a toner is molten, the occurrence of end-portion hot offset can be suppressed.

It is commonly known that if fine rigid materials are dispersed in a fluid having a certain viscosity, the fluid has an increased viscosity (thickening effect). Such a phenomenon may also be called "the Einstein viscosity law".

Based on the theory, the following study has been made: a toner molten at a high temperature is assumed to be a fluid, and a material having the thickening effect is added to toner particles (toner base particles) in advance. As a result, it has been found that while the low-temperature fixability is not inhibited, the thickening effect can be achieved in melting of the toner at a high temperature at which offset may occur, suppressing the occurrence of end-portion hot offset.

In the present invention, the following toner can be used to thereby suppress the end-portion hot offset.

The toner of the present invention is a toner including toner particles and an external additive, wherein each of the toner particles contains a binder resin, and organic-inorganic composite fine particles dispersed in the binder resin, and the organic-inorganic composite fine particles, (1) have a number-average particle diameter of 70 nm or more and 500 nm or less, (2) have a structure in which inorganic fine particles are embedded in a resin particle, convexes derived from the inorganic fine particles being present on the surfaces of the organic-inorganic composite fine particles, (3) have a shape factor SF-2 of 103 or more and 120 or less, and (4) contain a resin component in which a proportion of THF-insoluble matter based on the mass of the resin component is 95% by mass or more.

In order to improve the end-portion hot offset by the use of thickening effect, it is important that a material to be incorporated into the toner particles be of organic-inorganic composite fine particles having convexes. The organic-inorganic composite fine particles have a structure in which inorganic fine particles are embedded in the surface of a resin particle, and convexes derived from the inorganic fine particles are present on the surface of the organic-inorganic composite fine particles.

The organic-inorganic composite fine particles are required to have a shape factor SF-2 of 103 or more and 120 or less. Herein, the value of the shape factor SF-2 is determined using an enlarged image of the organic-inorganic composite fine particles, the image being taken using a scanning electron microscope at 200,000-fold magnification.

The reason for this is presumed as follows: if the model of the thickening effect is considered, and the molten toner and the organic-inorganic composite fine particles are regarded as a fluid and rigid materials, respectively, the thickening effect is more easily achieved as the number of interfaces between the rigid materials dispersed in the fluid and the fluid is larger.

When the SF-2 is less than 103, the thickening effect is hardly achieved, and consequently, end-portion hot offset tends to occur easily. In the case of a material in which convexes are difficult to form on the surface thereof, such as resin particles, the thickening effect is difficult to achieve.

The organic-inorganic composite fine particles are required to have a number-average particle diameter of 70 nm or more and 500 nm or less. When the number-average particle diameter is less than 70 nm, or more than 500 nm, the thickening effect is hardly obtained, and consequently, end-portion hot offset tends to occur easily.

The organic-inorganic composite fine particles contain a resin component in which the proportion of THF-insoluble matter based on the mass of the resin component is 95% by mass or more. The reason for this is because it is important for allowing the toner to achieve the thickening effect that the shape and the particle diameter of the organic-inorganic composite fine particles be maintained even at a fixing unit temperature at which the end-portion hot offset may occur. In addition, in the case where the proportion of the THF-insoluble matter is 95% by mass or more, the organic-inorganic composite fine particles can exhibit elasticity, and such a case is advantageous in terms of the suppression of end-portion hot offset. When the proportion of the THF-insoluble matter is less than 95% by mass, the organic-inorganic composite fine particles may be melted at a fixing unit temperature at which end-portion hot offset occurs, and it is difficult to achieve the thickening effect. Accordingly, the end-portion hot offset may be remarkably caused to occur.

The organic-inorganic composite fine particles preferably have neither endothermic peak nor glass transition point (Tg) in the range from 20° C. to 220° C., as measured by differential scanning calorimetry (DSC). It is indicated that while the fixing unit temperature is raised close to 200° C. at the time of the occurrence of end-portion hot offset, the resin in the organic-inorganic composite fine particles is hardly deformed in the range of at least up to 220° C.

For the toner of the present invention, a toner softening point Tm can be used as an index of the thickening effect. When the organic-inorganic composite fine particles in the present invention are added to increase the toner softening point, the end-portion hot offset can be improved while the fixability is maintained. When the organic-inorganic composite fine particles are not added and the softening point of the binder resin is simply raised to increase the toner softening point, however, the end-portion hot offset is improved, but the fixability tends to deteriorate easily. The reason why the fixability can be maintained even when the organic-inorganic composite fine particles are added to increase the softening point of the toner is considered because the melt viscosity of the toner in normal fixing is higher than the melt viscosity of the toner in the occurrence of end-portion hot offset, and consequently, the toner is not a fluid having a low viscosity so that the thickening effect is remarkably exerted.

The inorganic fine particles of the organic-inorganic composite fine particles in the present invention can be silica fine particles or metal oxide fine particles. When the inorganic fine particles of the organic-inorganic composite fine particles are silica fine particles or metal oxide fine particles, the toner has excellent chargeability to thereby improve the developability.

The organic-inorganic composite fine particles can be produced according to the description of Examples in International Publication No. WO2013/063291, for example.

The number-average particle diameter and the SF-2 of the organic-inorganic composite fine particles can be adjusted by changing the particle diameter of the inorganic fine particles for use in the organic-inorganic composite fine particles and the ratio of the amount of the inorganic fine particles to the amount of the resin.

The amount of the organic-inorganic composite fine particles added to the toner particles in the present invention can be appropriately adjusted depending on the degree of the thickening effect. The amount is preferably 0.1 parts by mass or more and 20 parts by mass or less based on 100 parts by mass of the binder resin.

The binder resin for use in the toner particles in the present invention is described.

Examples of the binder resin include a polyester type resin, a vinyl resin, an epoxy resin and a polyurethane resin. In particular, the binder resin may preferably be a polyester resin generally having a higher polarity in terms of developability, from the viewpoint of uniformly dispersing a charge control agent having polarity.

The composition of the polyester resin is as follows.

Examples of a dihydric alcohol component include, as chain aliphatic diols, ethylene glycol, diethylene glycol, triethylene glycol, 1,2-propylene glycol, 1,3-propylene glycol, dipropylene glycol, 1,4-butanediol, 1,4-butadiene glycol, trimethylene glycol, tetramethylene glycol, pentamethylene glycol, hexamethylene glycol, octamethylene glycol, nonamethylene glycol, decamethylene glycol and neopentyl glycol.

Examples of an aromatic diol include bisphenols represented by the following formula [2] and derivatives thereof, and diols represented by the following formula [3].

Formula [2]

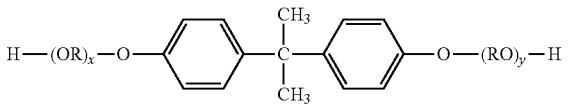

(wherein R represents an ethylene group or a propylene group, x and y each represent an integer of 1 or more, and the average value of x+y is 2 to 10.)

Formula [3]

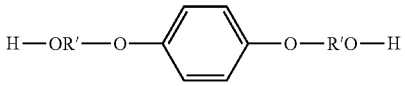

(wherein R' represents

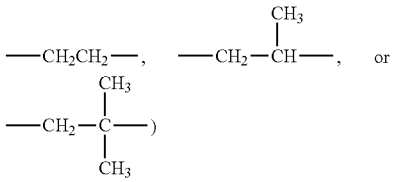

Examples of a divalent acid component include dicarboxylic acids and derivatives thereof, for example, benzenedicarboxylic acids, or anhydrides or lower alkyl esters thereof, such as phthalic acid, terephthalic acid, isophthalic acid and phthalic anhydride; alkyldicarboxylic acids, or anhydrides or lower alkyl esters thereof, such as succinic acid, adipic acid, sebacic acid and azelaic acid; alkenyl succinic acids or alkyl succinic acids, or anhydrides or lower alkyl esters thereof, such as n-dodecenyl succinic acid and n-dodecyl succinic acid; and unsaturated dicarboxylic acids, or anhydrides or lower alkyl esters thereof, such as fumaric acid, maleic acid, citraconic acid and itaconic acid.

In the present invention, preferred is a polyester which is obtained by polycondensation of a carboxylic acid component containing 90% by mol or more of an aromatic carboxylic acid compound with an alcohol component, wherein 80% by mol or more of the aromatic carboxylic acid compound is terephthalic acid and/or isophthalic acid.

In addition, a trihydric or higher alcohol component and a trivalent or higher acid component, serving as a crosslinking component may preferably be used singly or in combination in order to achieve more uniform dispersibility of an internal additive such as magnetic iron oxide or wax.

Examples of a trihydric or higher, polyhydric alcohol component include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane and 1,3,5-trihydroxybenzene.

Examples of a trivalent or higher, polyvalent carboxylic acid component include trimellitic acid, pyromellitic acid, 1,2,4-benzenetricarboxylic acid, 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, tetra(methylenecarboxyl)methane, 1,2,7,8-octanetetracarboxylic acid, Empol trimer acid and anhydrides thereof.

The amount of the alcohol component is preferably 40% by mol or more and 60% by mol or less and more preferably 45% by mol or more and 55% by mol or less based on the total of the alcohol component and the acid component.

The polyester resin is usually obtained by polycondensation generally known.

On the other hand, examples of a vinyl monomer for producing the vinyl resin include the following.

styrene; styrene derivatives such as o-methylstyrene, m-methylstyrene, p-methylstyrene, p-methoxystyrene, p-phenylstyrene, p-chlorostyrene, 3,4-dichlorostyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene and p-n-dodecylstyrene; unsaturated monoolefins such as ethylene, propylene, butylene and isobutylene; unsaturated polyenes such as butadiene and isoprene; vinyl halides such as vinyl chloride, vinylidene chloride, vinyl bromide and vinyl fluoride; vinyl esters such as vinyl acetate, vinyl propionate and vinyl benzoate; α-methylene aliphatic monocarboxylic acid esters such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate and diethylaminoethyl methacrylate; acrylic acid esters such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate and phenyl acrylate; vinyl ethers such as vinyl methyl ether, vinyl ethyl ether and vinyl isobutyl ether; vinyl ketones such as vinyl methyl ketone, vinyl hexyl ketone and methyl isopropenyl ketone; N-vinyl compounds such as N-vinyl pyrrole, N-vinyl carbazole, N-vinyl indole and N-vinyl pyrrolidone; vinyl naphthalines; and acrylic acid or methacrylic acid derivatives such as acrylonitrile, methacrylonitrile and acrylamide.

Furthermore, the examples include unsaturated dibasic acids such as maleic acid, citraconic acid, itaconic acid, alkenyl succinic acid, fumaric acid and mesaconic acid; unsaturated dibasic acid anhydrides such as maleic anhydride, citraconic anhydride, itaconic anhydride and an alkenyl succinic anhydride; unsaturated dibasic acid half esters such as methyl maleate half ester, ethyl maleate half ester, butyl maleate half ester, methyl citraconate half ester, ethyl citraconate half ester, butyl citraconate half ester, methyl itaconate half ester, methyl alkenylsuccinate half ester, methyl fumarate half ester and methyl mesaconate half ester; unsaturated dibasic acid esters such as dimethyl malate and dimethyl fumarate; α,β-unsaturated acids such as acrylic acid, methacrylic acid, crotonic acid and cinnamic acid; α,β-unsaturated acid anhydrides such as crotonic anhydride and cinnamic anhydride, and anhydrides of the α,β-unsaturated acids and lower fatty acids; and monomers having a carboxyl group, such as alkenylmalonic acid, alkenylglutaric acid, alkenyladipic acid, and acid anhydrides thereof and monoesters thereof.

Furthermore, the examples include acrylic acid or methacrylic acid esters such as 2-hydroxyethyl acrylate, 2-hydroxyethyl methacrylate and 2-hydroxypropyl methacrylate; and monomers having a hydroxy group, such as 4-(1-hydroxy-1-methylbutyl)styrene and 4-(1-hydroxy-1-methylhexyl)styrene.

In the toner of the present invention, the vinyl resin as the binder resin may have a crosslinking structure formed by crosslinking with a crosslinking agent having two or more vinyl groups.

Examples of the crosslinking agent used here include aromatic divinyl compounds such as divinyl benzene and divinyl naphthalene; diacrylate compounds bound by an alkyl chain, such as ethylene glycol diacrylate, 1,3-butylene glycol diacrylate, 1,4-butanediol diacrylate, 1,5-pentanediol acrylate, 1,6-hexanediol diacrylate, neopentyl glycol diacrylate and such compounds whose acrylates are replaced with methacrylates; diacrylate compounds bound by an alkyl chain having an ether bond, such as diethylene glycol diacrylate, triethylene glycol diacrylate, tetraethylene glycol diacrylate, polyethylene glycol #400 diacrylate, polyethylene glycol #600 diacrylate, dipropylene glycol diacrylate and such compounds whose acrylates are replaced with methacrylates; diacrylate compounds bound by a chain having an aromatic group and an ether bond, such as polyoxyethylene (2)-2,2-bis(4-hydroxyphenyl)propane diacrylate, polyoxyethylene (4)-2,2-bis(4-hydroxyphenyl)propane diacrylate and such compounds whose acrylates are replaced with methacrylates; and polyester type diacrylate compounds such as trade name MANDA (Nippon Kayaku Co., Ltd.).

In addition, examples of a polyfunctional crosslinking agent include pentaerythritol triacrylate, trimethylolethane triacrylate, trimethylolpropane triacrylate, tetramethylolmethane tetraacrylate, oligoester acrylate and such compounds whose acrylates are replaced with methacrylates; and triallyl cyanurate and triallyl trimellitate.

Such a crosslinking agent can be used preferably in an amount of 0.01 parts by mass or more and 10 parts by mass or less, more preferably 0.03 parts by mass or more and 5 parts by mass or less, based on 100 parts by mass of other monomer components.

In particular, examples of the crosslinking agent suitably used include aromatic divinyl compounds (particularly divinylbenzene), and diacrylate compounds bound by a chain having an aromatic group and an ether bond.

In addition, examples of a polymerization initiator for use in production of a vinyl copolymer include 2,2'-azobisisobutyronitrile, 2,2'-azobis(4-methoxy-2,4-dimethylvaleronitrile), 2,2'-azobis(2,4-dimethylvaleronitrile), 2,2'-azobis(2-methylbutyronitrile), dimethyl-2,2'-azobisisobutyrate, 1,1'-azobis(1-cyclohexanecarbonitrile), 2-(carbamoylazo)-isobutyronitrile, 2,2'-azobis(2,4,4-trimethylpentane), 2-phenylazo-2,4-dimethyl-4-methoxyvaleronitrile, 2,2-azobis(2-methylpropane), ketone peroxides such as methyl ethyl ketone peroxide, acetylacetone peroxide and cyclohexanone peroxide, 2,2-bis(t-butylperoxy)butane, t-butyl hydroperoxide, cumene hydroperoxide, 1,1,3,3-tetramethylbutyl hydroperoxide, di-t-butyl peroxide, t-butylcumyl peroxide, dicumyl peroxide, α,α'-bis(t-butylperoxyisopropyl)benzene, isobutyl peroxide, octanoyl peroxide, decanoyl peroxide, lauroyl peroxide, 3,5,5-trimethyl hexanoyl peroxide, benzoyl peroxide, m-trioyl peroxide, di-isopropyl peroxydicarbonate, di-2-ethylhexyl peroxydicarbonate, di-n-propyl peroxydicarbonate, di-2-ethoxyethyl peroxycarbonate, dimethoxyisopropyl peroxydicarbonate, di(3-methyl-3-methoxybutyl)peroxycarbonate, acetylcyclohexylsulfonyl peroxide, t-butyl peroxyacetate, t-butyl peroxyisobutyrate, t-butyl peroxyneodecanoate, t-butyl peroxy-2-ethylhexanoate, t-butyl peroxylaurate, t-butyl peroxybenzoate, t-butyl peroxyisopropylcarbonate, di-t-butyl peroxyisophthalate, t-butyl peroxyallylcarbonate, t-amyl peroxy-2-ethylhexanoate, di-t-butyl peroxyhexahydroterephthalate and di-t-butyl peroxyazelate.

The binder resin may preferably have a glass transition point (Tg) of 45° C. or higher and 70° C. or lower, and more preferably 50° C. or higher and 70° C. or lower in terms of storage properties and low-temperature fixability. The binder resin may preferably have a softening point Tm of 90° C. or higher and 130° C. or lower from the viewpoint that end-portion hot offset is suppressed while the low-temperature fixability is maintained.

The toner of the present invention may further contain magnetic particles and may also be used as a magnetic toner. In the case, magnetic iron oxide particles can also serve as a colorant.

In the present invention, examples of the magnetic particles contained in the magnetic toner include iron oxides such as magnetite, hematite and ferrite, metals such as iron, cobalt and nickel, and metal alloys and mixtures of such metals with metals such as aluminum, cobalt, copper, lead, magnesium, tin, zinc, antimony, bismuth, calcium, manganese, titanium, tungsten and vanadium.

The magnetic particles may preferably have an average particle diameter of 2 μm or less, and more preferably 0.05 μm or more and 0.5 μm or less. The amount of the magnetic particles contained in the toner is preferably 20 parts by mass or more and 200 parts by mass or less based on 100 parts by mass of the binder resin, and particularly preferably 40 parts by mass or more and 150 parts by mass or less based on 100 parts by mass of the binder resin.

With respect to the colorant for use in the present invention, carbon black, grafted carbon, or a colorant toned to black by the use of yellow/magenta/cyan colorants shown below can be utilized as a black colorant.

Examples of the yellow colorant include compounds represented by a condensed azo compound, an isoindolinone compound, an anthraquinone compound, an azo metal complex, a methine compound and an allylamide compound.

Examples of the magenta colorant include a condensed azo compound, a diketopyrrolopyrrole compound, anthraquinone, a quinacridone compound, a base dye lake compound, a naphthol compound, a benzimidazolone compound, a thioindigo compound and a perylene compound.

Examples of the cyan colorant include a copper phthalocyanine compound and derivatives thereof, an anthraquinone compound and a base dye lake compound. Such colorants can be used singly or as a mixture, and can also be used in the state of a solid solution.

The colorant is selected in terms of hue angle, chroma, lightness, weather resistance, OHP transparency, and dispersibility in the toner. The amount of the colorant added is 1 part by mass or more and 20 parts by mass or less based on 100 parts by mass of the binder resin.

The toner of the present invention may contain a wax.

The wax for use in the present invention is as follows. Examples include aliphatic hydrocarbon type waxes such as low molecular weight polyethylene, low molecular weight polypropylene, a polyolefin copolymer, polyolefin wax, microcrystalline wax, paraffin wax and Fischer-Tropsch wax; oxides of aliphatic hydrocarbon type waxes, such as oxidized polyolefin wax; or block copolymers thereof; vegetable waxes such as candelilla wax, carnauba wax, Japanese wax and jojoba wax; animal waxes such as beeswax, lanolin and spermaceti; mineral waxes such as ozokerite, ceresin and petrolatum; waxes mainly including an aliphatic ester, such as montanic acid ester and castor wax; and waxes in which an aliphatic ester is partially or entirely deoxidized, such as deoxidized carnauba wax. Furthermore, examples include saturated straight fatty acids such as palmitic acid, stearic acid, montanic acid, and long-chain alkyl carboxylic acids having a longer chain alkyl group; unsaturated fatty acids such as brassidic acid, eleostearic acid and valinaric acid; saturated alcohols such as stearyl alcohol, eicosyl alcohol, behenyl alcohol, carnaubyl alcohol, ceryl alcohol, melissyl alcohol, and alkyl alcohols having a longer chain alkyl group; polyhydric alcohols such as sorbitol; aliphatic amides such as linoleic amide, oleic amide and lauric amide; saturated aliphatic bisamides such as methylenebisstearic amide, ethylenebiscapric amide, ethylenebislauric amide and hexamethylenebisstearic amide; unsaturated fatty acid amides such as ethylenebisoleic amide, hexamethylenebisoleic amide, N,N'-dioleyladipic amide and N,N'-dioleylsebacic amide; aromatic bisamides such as m-xylenebisstearic amide and N,N'-distearyl isophthalic amide; aliphatic metal salts (generally so-called metal soaps) such as calcium stearate, calcium laurate, zinc stearate and magnesium stearate; waxes obtained by grafting a vinyl monomer such as styrene and acrylic acid to aliphatic hydrocarbon type wax; partially esterified products of a fatty acid and a polyhydric alcohol, such as behenic acid monoglyceride; and methyl ester compounds having a hydroxyl group, obtained by hydrogenating vegetable fats and oils.

In addition, the waxes, in which the molecular weight distribution is made sharper by using a press-sweating method, a solvent method, a recrystallization method, a vacuum distillation method, a supercritical gas extraction method or a melt-crystallization method, and the waxes, from which a low molecular weight solid fatty acid, a low molecular weight solid alcohol, a low molecular weight solid compound and other impurities are removed, can also be used.

Specific examples of wax that can be used as a release agent include Viscol (trade mark) 330-P, 550-P, 660-P and TS-200 (Sanyo Chemical Industries, Ltd.), Hi-Wax 400P, 200P, 100P, 410P, 420P, 320P, 220P, 210P and 110P (Mitsui Chemicals, Inc.), Sasol H1, H2, C80, C105 and C77 (Schumann Sasol), HNP-1, HNP-3, HNP-9, HNP-10, HNP-11 and HNP-12 (Nippon Seiro Co., Ltd.), Unilin (trade mark) 350, 425, 550 and 700, Unicid (trade mark) 350, 425, 550 and 700 (Toyo-Petrolite Co., Ltd.), Japanese wax, beeswax, rice wax, candelilla wax, and carnauba wax (available from Cerarica NODA Co., Ltd.).

The toner of the present invention may preferably further contain a charge control agent in order to stabilize the chargeability of the toner. As such a charge control agent, an organic metal complex or a chelate compound is useful in which a center metal easily interacts with an acid group or a hydroxyl group present in the terminal of the binder resin for use in the present invention. Examples of the charge control agent include monoazo metal complexes; acetylacetone metal complexes; and metal complexes or metal salts of aromatic hydroxycarboxylic acids or aromatic dicarboxylic acids.

Specific examples of the charge control agent that can be used include Spilon Black TRH, T-77 and T-95 (Hodogaya Chemical Industries Co., Ltd.), and BONTRON (trade mark) S-34, S-44, S-54, E-84, E-88 and E-89 (Orient Chemical Industries Co., Ltd.). In addition, a charge control resin can also be used in combination with the above charge control agent.

The toner of the present invention may include a fluidity improver and other external additives, in order to enhance the fluidity and the chargeability of the toner.

Examples of the fluidity improver include fluororesin powders such as a vinylidene fluoride fine powder and a polytetrafluoroethylene fine powder; fine powder silicas such as wet process silica and dry process silica, a titanium oxide fine powder, an alumina fine powder, and treated silicas prepared by surface-treating the fine powder silicas with a silane compound, a titanium coupling agent or a silicone oil; oxides such as zinc oxide and tin oxide; multiple oxides such as strontium titanate, barium titanate, calcium titanate, strontium zirconate and calcium zirconate; and carbonate compounds such as calcium carbonate and magnesium carbonate.

The fluidity improver is preferably a fine powder produced by vapor-phase oxidation of a silicon halide compound, so-called dry process silica or fumed silica. For example, such silica is obtained by utilizing a pyrolytic oxidation reaction of silicon tetrachloride gas in an oxy-hydrogen flame, and the basic reaction formula is as follows.

$$SiCl_4+2H_2+O_2 \rightarrow SiO_2+4HCl$$

In the production step, the silicon halide compound can also be used together with other metal halide compound such as aluminum chloride or titanium chloride to thereby provide a composite fine powder of silica and other metal oxide, and the silica includes those materials.

The fluidity improver may preferably have a number-average particle diameter of 5 nm or more and 30 nm or less because the toner can have higher chargeability and better fluidity.

Furthermore, the fluidity improver for use in the present invention is more preferably a silica fine powder which is produced by the above gas phase oxidation of silicon halide compound, followed by a hydrophobization treatment.

The fluidity improver is preferably a fluidity improver having a specific surface area by nitrogen adsorption, measured by the BET method, of 30 $m^2/g$ or more and 300 $m^2/g$ or less.

The fluidity improver is preferably used in an amount of 0.01 parts by mass or more and 3 parts by mass or less in total, based on 100 parts by mass of the toner particles.

The toner of the present invention can be used as a one-component developer, or can be used as a two-component developer in combination with a carrier. As the carrier for use in a two-component development method, any carrier conventionally known can be used. Specifically, a metal such as iron, nickel, cobalt, manganese, chromium or rare earth, or an alloy or an oxide thereof, whose surface is oxidized or not oxidized, may preferably be used.

In addition, a carrier having carrier core particles which are provided on their surfaces with a coating layer of a styrene resin, an acrylic resin, a silicone resin, a fluororesin, a polyester resin or the like can be used.

The method for producing the toner particles in the present invention is not particularly limited, and a so-called grinding method can be used in which toner constituent materials such as the resin component, the colorant, the wax and the charge control agent are uniformly mixed and then melt-kneaded, and the resulting kneaded product is cooled, then ground by a jet mill or the like, and sufficiently mixed with the fluidity modifier or the like using a mixing machine such as a Henschel mixer to provide a developer of the present invention.

When the toner is prepared by the grinding method, the binder resin, the colorant, the wax, the charge control agent and the like constituting the toner particles can be sufficiently mixed by a mixing machine such as a Henschel mixer or a ball mill, then melt-kneaded using a heat kneading machine such as a twin screw kneading extruder, a heating roll, a kneader or an extruder to allow the resins to be mutually compatible. The wax, magnetic iron oxide particles and a metal-containing compound are dispersed or dissolved the resins, and the resultant is cooled and solidified for grinding and classification, thereby providing toner particles according to the present invention.

Desired external additives can be, if necessary, sufficiently mixed therewith by a mixing machine such as a Henschel mixer, providing a toner according to the present invention.

Examples of the mixing machine include the following: Henschel mixer (manufactured by Nippon Coke & Engineering Co., Ltd.); Super Mixer (manufactured by Kawatamfg Co., Ltd.); Ribocone (manufactured by Okawara Mfg. Co., Ltd.); Nauta Mixer, Turbulizer and Cyclomix (manufactured by Hosokawa Micron Corporation); Spiral Pin Mixer (manufactured by Pacific Machinery & Engineering Co., Ltd.); and Loedige Mixer (manufactured by Matsubo Corporation).

Examples of the kneading machine include the following: KRC kneader (manufactured by Kurimoto, Ltd.); Buss Co-Kneader (manufactured by Buss Co.); TEM type Extruder (manufactured by Toshiba Machine Co., Ltd.); TEX twin screw kneader (manufactured by Japan Steel Works, Ltd.); PCM kneader (manufactured by Ikegai Corp.); Three-Roll Mill, Mixing Roll Mill and Kneader (manufactured by Inoue mfg, Inc.); Kneadex (manufactured by Mitsui Mining Co., Ltd.); MS type Pressure Kneader, Kneader-Ruder (manufactured by Moriyama Manufacturing); and Banbury Mixer (manufactured by Kobe Steel, Ltd.).

Examples of a grinding machine include the following: Counter Jet Mill, Micron Jet and Inomizer (manufactured by Hosokawa Micron Corporation); IDS type Mill and PJM Jet Grinder (manufactured by Nippon Pneumatic Mfg. Co., Ltd.); Cross Jet Mill (manufactured by Kurimoto, Ltd.); Ulmax (manufactured by Nisso Engineering Co., Ltd.); SK Jet O-Mill (manufactured by Seishin Enterprice Co., Ltd.); Kriptron (manufactured by Kawasaki Heavy Industries, Ltd.); Turbo Mill (manufactured by Turbo Kogyo, Co., Ltd.); and Super Rotor (manufactured by Nisshin Engineering Inc.).

Examples of a classifying machine include the following: Classyl, Micron Classifier and Spedic Classifier (manufactured by Seishin Enterprice Co., Ltd.); Turbo Classifier (manufactured by Nisshin Engineering Inc.); Micron Separator, Turboprex (ATP) and TSP Separator (manufactured by Hosokawa Micron Corporation); Elbow Jet (manufactured by Nittetsu Mining Co., Ltd.), Dispersion Separator (manufactured by Nippon Pneumatic Mfg. Co., Ltd.); and YM Microcut (manufactured by Yasukawa & Co., Ltd.).

Examples of a sieve apparatus for use in sieving of coarse particles include the following: Ultrasonic (manufactured by Koei Sangyo Co., Ltd.); Rezona Sieve and Gyro Sifter (Tokuju Co., Ltd.); Vibrasonic System (manufactured by Dulton Company Limited); Sonicreen (manufactured by Sintokogio, Ltd.); Turbo-Screener (manufactured by Turbo Kogyo, Co., Ltd.); Microsifter (manufactured by Makino Mfg. Co., Ltd.); and a circular vibrating sieve.

The toner particles can also be produced by a so-called polymerization method such as an emulsion polymerization method, a suspension polymerization method or a dissolution suspension method, as other procedure.

Measurements of various physical properties of the toner of the present invention will be described below.

<Measurement Methods for Melting Point and Glass Transition Temperature Tg of Resin of Organic-Inorganic Composite Fine Particles>

The melting point and the glass transition temperature Tg of the resin of the organic-inorganic composite fine particles are measured using a differential scanning calorimetry apparatus "Q1000" (trade name: manufactured by TA Instruments) according to ASTM D3418-82. The temperature correction of a detecting part of the apparatus is performed using the melting points of indium and zinc, and the correction of an amount of heat is performed using the heat of fusion of indium.

Specifically, about 0.5 mg of a sample (organic-inorganic composite fine particles) is precisely weighed and placed in an aluminum pan, and subjected to measurement in a measurement temperature range of 20° C. or higher and 220° C. or lower at a rate of temperature rise of 10° C./min with an empty aluminum pan being used as a reference. Herein, the measurement is made as follows: the temperature is raised to 220° C. once, subsequently lowered to 20° C. at a rate of temperature drop of 10° C./min, and thereafter raised again at a rate of temperature rise of 10° C./min. The DSC curve obtained in the second temperature rise process is used to determine physical properties defined in regard to the present invention.

In the DSC curve, the temperature at which the largest endothermic peak in a temperature range from 20 to 220° C. is shown in the DSC curve is defined as the melting point of the resin of the organic-inorganic composite fine particles.

In the DSC curve, the intersection point of the DSC curve with the line of the intermediate point on the baseline set between the start and the end of the change in specific heat is defined as the glass transition temperature Tg of the resin of the organic-inorganic composite fine particles.

<Measurement Method for Tg of Binder Resin>

The Tg of the binder resin was determined by the same method as in the Tg of the resin of the organic-inorganic composite fine particles.

<Measurement of Softening Points Tm of Binder Resin and Toner>

The softening points Tm of the binder resin used in the present invention and the toner are determined by the following method. The softening points Tm of the binder resin and the toner are measured using a constant-load extrusion type capillary rheometer "Flow Characteristics Evaluation Apparatus Flow Tester CFT-500D" (manufacture by Shimadzu Corporation) according to a manual attached to the apparatus. In the apparatus, a constant load is applied from above a measuring sample by a piston, during which the measuring sample, which is filled in a cylinder, is melted by raising the temperature. The measuring sample melted is extruded from a die provided at the bottom of the cylinder, and a flow curve showing the relationship between the level of descent of the piston and the temperature can be obtained. In the present invention, "Melting temperature in ½ method" described in the manual attached to the "Flow Characteristics Evaluation Apparatus Flow Tester CFT-500D" is defined as the softening point. Herein, the "Melting temperature in ½ method" is calculated as follows: first, the value of ½ of the difference between the level of descent, Smax, of the piston at the point of time where flowing out of the sample is completed and the level of descent, Smin, of the piston at the point of time where flowing out of the sample is started (the value is represented by X, and X=(Smax−Smin)/2) is determined; then, the temperature of the flow curve at the time where the level of descent of the piston reaches the sum of X and Smin in the flow curve is the "Melting temperature in ½ method".

As the measuring sample, a cylindrical sample having a diameter of about 8 mm is used which is obtained by subjecting about 1.6 g of the binder resin or about 1.8 g of the toner to compression molding at about 10 MPa for about 60 seconds in an environment of 25° C. using a tablet compression molding machine (for example, NT-100H, manufactured by NPa System Co., Ltd.).

Measurement conditions by CFT-500D are as follows.

Test mode: temperature rise method
Starting temperature: 30° C.
Reaching temperature: 200° C.
Measurement interval: 1.0° C.
Rate of temperature rise: 6.0° C./min
Cross-sectional area of piston: 1.000 $cm^2$
Testing load (piston load): 30.0 kgf (0.9807 MPa)
Preheating time: 300 seconds
Hole diameter of die: 1.0 mm
Length of die: 1.0 mm <Measurement Method for Weight-Average Particle Diameter (D4) of Toner>

The weight-average particle diameter (D4) of the toner is calculated as follows. A precision particle size distribution measurement apparatus "Coulter Counter Multisizer 3" (trade mark, manufactured by Beckman Coulter) equipped with a 100 μm-aperture tube by a pore electrical resistance method is used. Setting of the measurement conditions and analysis of the measurement data are performed using the attached dedicated software "Beckman Coulter Multisizer 3 Version 3.51" (manufactured by Beckman Coulter). Herein, the measurement is performed in an effective number of measurement channels of 25,000.

An aqueous electrolyte solution for use in the measurement can be a solution obtained by dissolving special grade sodium chloride in ion exchange water so that the concentration is about 1% by mass, and for example, "ISOTON II" (produced by Beckman Coulter) can be used.

Herein, before the measurement and the analysis, the dedicated software is set up as follows.

In the window "Changing Standard Operating Method (SOM)" of the dedicated software, the total count number in a control mode is set at 50,000 particles, the number of measurements is set at 1, and as the Kd value, the value obtained by using "Standard Particles 10.0 μm" (produced by Beckman Coulter) is set. The "Threshold/Measure Noise Level button" is pressed to thereby automatically set the threshold and the noise level. In addition, the current is set at 1,600 μA, the gain is set at 2, the electrolytic solution is set at ISOTON II, and "Flush Aperture Tube after each run" is checked.

In the window "Convert Pulses to Size" of the dedicated software, the interval between bins is changed to logarithmic particle diameter, the particle diameter bin is set at 256 particle diameter bin, and the particle diameter range is set at 2 μm to 60 μm.

A specific measurement method is as follows.

(1) A 250-mL round-bottom beaker made of glass, for exclusive use for Multisizer 3, is charged with about 200 mL of the aqueous electrolyte solution and placed on a sample stand, and the electrolyte solution was stirred by rotating a stirrer rod counterclockwise at 24 rotations/second. Then, the "Flush Aperture" function of the dedicated software is used to remove contaminants and air bubbles within an aperture tube.

(2) A 100 mL flat-bottom beaker made of glass is charged with about 30 mL of the aqueous electrolyte solution. About 0.3 mL of a dilution solution, prepared by diluting "Contaminon N" (an aqueous 10% by mass solution of a neutral detergent for cleaning precision measuring equipment, including a nonionic surfactant, an anion surfactant and an organic builder, pH7; produced by Wako Pure Chemical Industries Ltd.) as a dispersant, with ion exchange water about three fold by mass is added thereto.

(3) An ultrasonic disperser "Ultrasonic Dispersion System Tetora 150" (manufactured by Nikkaki Bios Co., Ltd) having an electric output of 120 W, which disperser is provided with two oscillators therein, having an oscillation frequency of 50 kHz with the respective phases shifted by 180°, is prepared. A water tank of the ultrasonic disperser is charged with about 3.3 L of ion exchange water, and about 2 mL of Contaminon N is added into the water tank.

(4) The beaker in (2) is placed in a beaker fixing hole of the ultrasonic disperser and the ultrasonic disperser is operated. Then, the height position of the beaker is adjusted so that the resonant condition of the liquid surface of the aqueous electrolyte solution in the beaker reaches the maximum.

(5) While ultrasonic wave is applied to the aqueous electrolyte solution in the beaker in (4), about 10 mg of the toner is added to the aqueous electrolyte solution little by little and dispersed. Then, the dispersion treatment with ultrasonic wave is continued for additional 60 seconds. Herein, in the dispersion with ultrasonic wave, the temperature of water in the water tank is appropriately regulated so as to fall within the range of 10° C. or higher and 40° C. or lower.

(6) The aqueous electrolyte solution in (5) having the toner dispersed therein is dropped to the round-bottom beaker in (1), disposed in the sample stand, by using a pipette, and the measurement concentration is adjusted to about 5%. Then, the measurement is performed until the number of particles measured reaches 50,000.

(7) The measurement data is analyzed by the dedicated software attached to the apparatus to calculate the weight-average particle diameter (D4). Herein, "average diameter" in the window "Analyze/Volume Statistics (Arithmetic)" in setting of Graph/Volume % in the dedicated software is the weight-average particle diameter (D4).

<Measurement Method for Content of Inorganic Fine Particles in Organic-Inorganic Composite Fine Particles>

The measurement of the content of the inorganic fine particles in the organic-inorganic composite fine particles was performed using a thermogravimetric analyzer (TGA) "Q5000IR Model" (manufactured by TA Instruments) as follows.

About 0.03 g of the organic-inorganic composite fine particles as a sample was charged in a special pan of "Q5000IR Model", and set in the measurement machine. Here, the amount of the sample was appropriately adjusted in consideration of the bulkiness of the organic-inorganic composite fine particles. After the condition of equilibrium was achieved at 50° C. and at ordinary pressure and then kept for 10 minutes, the mass of the sample, (A), was measured. Subsequently, after nitrogen gas was supplied and the temperature is raised to 900° C. at a rate of temperature rise of 20° C./min at ordinary pressure in a nitrogen atmosphere, the mass of the sample, (B), was measured.

The content [% by mass] of the inorganic fine particles in the organic-inorganic composite fine particles is the mass of the sample, (B), after the temperature rise to 900° C. relative to the mass of the sample, (A), after keeping at 50° C. for 10 minutes, and was determined by the following expression.

$$\text{Content [\% by mass] of inorganic fine particles in organic-inorganic composite fine particles} = (B/A) \times 100$$

<Measurement Method for Number-Average Particle Diameter of Primary Particles of Organic-Inorganic Composite Fine Particles>

The number-average particle diameter of primary particles of the organic-inorganic composite fine particles was determined by using a scanning electron microscope (SEM) "S-4800" (manufactured by Hitachi Ltd.) to observe the organic-inorganic composite fine particles.

While the observation magnification was appropriately adjusted depending on the size of the organic-inorganic composite fine particles, the longer diameters of 100 primary particles in the field of view expanded up to 200,000-fold magnification were measured, and the average value thereof was defined as the number-average particle diameter.

<Measurement Method for Number-Average Particle Diameters of Primary Particles of Organic Fine Particles and Inorganic Fine Particles>

The number-average particle diameters of primary particles of the organic fine particles and the inorganic fine particles were determined by the same method as the measurement method for the number-average particle diameter of primary particles of the organic-inorganic composite fine particles.

<Measurement Method for Shape Factor SF-2 of Organic-Inorganic Composite Fine Particles>

The shape factor SF-2 of the organic-inorganic composite fine particles was calculated as follows, wherein the organic-inorganic composite fine particles were observed using a scanning electron microscope (SEM) "S-4800" (manufactured by Hitachi Ltd.). While the observation magnification was appropriately adjusted depending on the size of the organic-inorganic composite fine particles, the perimeters and the areas of 100 primary particles in the field of view expanded up to 200,000-fold magnification were calculated using the image processing software "Image-Pro Plus 5.1J" (manufactured by Media Cybernetics Inc.). The shape factor SF-2 was calculated by the following expression, and the average value thereof was defined as the shape factor SF-2 of the organic-inorganic composite fine particles.

$$\text{SF-2} = (\text{Perimeter of particle})^2/\text{Area of particle} \times 100/4\pi$$

<Measurement Method for Shape Factors SF-2 of Organic Fine Particles and Inorganic Fine Particles>

The shape factors SF-2 of the organic fine particles and the inorganic fine particles were determined by the same method as the measurement method for the shape factor SF-2 of the organic-inorganic composite fine particles.

<Measurement Method for Proportion of THF-Insoluble Matter in Resin Component of Organic-Inorganic Composite Fine Particles>

The proportion of the THF-insoluble matter in the resin component of the organic-inorganic composite fine particles was quantitatively determined as follows.

About 0.1 g of the organic-inorganic composite fine particles are precisely weighed (Wc[g]), and charged in a bottle for centrifugation (for example, trade name "Oak Ridge Centrifuge Tube 3119-0050" (size: 28.8×106.7 mm) manufactured by Nalgene) weighed in advance. Twenty (20) g of THF is added thereto, and the resultant is left to stand for 24 hours to extract THF soluble matter. Then, the bottle for centrifugation was placed in a centrifuge "himac CR22G" (manufactured by Hitachi Koki Co., Ltd.), and subjected to centrifugation at 20° C. and 15,000 rpm for 1 hour, thereby allowing the THF-insoluble matter of the entire organic-inorganic composite fine particles to be sufficiently precipitated. The bottle for centrifugation was taken out, the extraction liquid of THF-soluble matter was separated and removed, and the bottle for centrifugation in which the contents remained placed was dried under vacuum at 40° C. for 8 hours. The bottle for centrifugation was weighed, and the mass of the bottle for centrifugation, weighed in advance, was subtracted therefrom to thereby determine the mass of the THF-insoluble matter of the entire organic-inorganic composite fine particles (Wr[g]).

The proportion of the THF-insoluble matter [% by mass] in the resin of the organic-inorganic composite fine particles was calculated by the following expression in which the content of the inorganic fine particles in the organic-inorganic composite fine particles is represented by Wi [% by mass].

$$\text{Proportion of THF-insoluble matter[\% by mass]in resin component of organic-inorganic composite fine particles}=\{(Wr-Wc\times Wi/100)/Wc\times(100-Wi)/100\}\times 100$$

<Measurement Method for Proportion of THF-Insoluble Matter in Resin Component of Organic Fine Particles>

The proportion of the THF-insoluble matter in the resin component of the organic fine particles was determined by the same method as the measurement of the proportion of the THF-insoluble matter in the resin component of the organic-inorganic composite fine particles. Herein, the organic fine particles contain no inorganic fine particles, and thus the proportion is calculated as assuming Wi to zero (0).

EXAMPLES

Hereinafter, the present invention will be described in more detail with reference to Examples and Comparative Examples, but the present invention is not limited thereto at all. Herein, all "part(s)" in Examples and Comparative Examples are by mass unless otherwise noted.

<Production Example for Polyester Resin>

| | |
|---|---|
| Bisphenol A-propylene oxide 2-mol adduct | 400 g |
| Bisphenol A-propylene oxide 3-mol adduct | 280 g |
| Terephthalic acid | 120 g |
| Isophthalic acid | 120 g |

The above monomers for polyester, and 2 g of tetrabutyl titanate as a condensation catalyst were charged in a reaction vessel and reacted at 220° C. under a nitrogen stream while water generated being distilled off. Then, the resultant was cooled to 180° C., and 250 g of trimellitic anhydride was added thereto for reaction. After the completion of the reaction, the content was taken out from the vessel, cooled, and ground to provide a polyester resin. The reaction time was controlled in the production method to thereby prepare polyester resins shown in Table 1.

TABLE 1

| Binder resin | Tm (° C.) | Tg (° C.) |
|---|---|---|
| Polyester resin 1 | 118 | 60 |
| Polyester resin 2 | 112 | 59 |
| Polyester resin 3 | 105 | 57 |

<Organic-Inorganic Composite Fine Particles 1 to 8>

The organic-inorganic composite fine particles can be produced according to the description of Examples in International Publication No. WO2013/063291.

Organic-inorganic composite fine particles 1 to 6 and 8, as the organic-inorganic composite fine particles for use in Examples described later, were prepared by the use of silica materials shown in Table 2 and according to Example 1 in International Publication No. WO2013/063291. Organic-inorganic composite fine particles 7 was prepared by the use of silica shown in Table 2 and according to Example 10 in International Publication No. WO2013/063291. Physical properties of organic-inorganic composite fine particles 1 to 8 are shown in Table 2. Organic-inorganic composite fine particles 1 to 6 and 8 had neither endothermic peak nor glass transition point (Tg) in the range from 20° C. to 220° C., as measured by differential scanning calorimetry (DSC). While organic-inorganic composite fine particles 7 had no endothermic peak but had a glass transition point (Tg) of 80° C.

In addition, organic-inorganic composite fine particles 1 to 8 had convexes derived from the inorganic fine particles, on the surfaces thereof.

TABLE 2

| | Inorganic fine particles in organic-inorganic composite fine particles | | Organic-inorganic composite fine particles | | | |
|---|---|---|---|---|---|---|
| | Type | Particle diameter (nm) | Content of inorganic fine particles (% by mass) | Number-average particle diameter (nm) | SF2 | THF-insoluble matter in resin (%) |
| Organic-inorganic composite fine particles 1 | Colloidal Silica | 25 | 55 | 113 | 112 | 99 |
| Organic-inorganic composite fine particles 2 | Colloidal Silica | 20 | 68 | 71 | 108 | 99 |
| Organic-inorganic composite fine particles 3 | Colloidal Silica | 50 | 44 | 185 | 112 | 100 |
| Organic-inorganic composite fine particles 4 | Colloidal Silica | 15 | 46 | 99 | 104 | 98 |
| Organic-inorganic composite fine particles 5 | Colloidal Silica | 25 | 67 | 106 | 116 | 99 |
| Organic-inorganic composite fine particles 6 | Colloidal Silica | 15 | 64 | 62 | 104 | 99 |

TABLE 2-continued

| | Inorganic fine particles in organic-inorganic composite fine particles | | Organic-inorganic composite fine particles | | | |
|---|---|---|---|---|---|---|
| | Type | Particle diameter (nm) | Content of inorganic fine particles (% by mass) | Number-average particle diameter (nm) | SF2 | THF-insoluble matter in resin (%) |
| Organic-inorganic composite fine particles 7 | Colloidal Silica | 25 | 50 | 190 | 108 | 75 |
| Organic-inorganic composite fine particles 8 | Colloidal Silica | 25 | 28 | 335 | 106 | 99 |

<Other Additives>

Physical properties of organic fine particles and physical properties of inorganic fine particles, as additives for use in other application than the organic-inorganic composite fine particles in Production Examples for toner described later, are shown in Table 3 and Table 4, respectively. Epostar S (organic fine particles 1) and Epostar S6 (organic fine particles 2) produced by Nippon Shokubai Co., Ltd. were used for the organic fine particles. Herein, organic fine particles 1 to 2, and inorganic fine particles 1 had neither endothermic peak nor glass transition point (Tg) in the range from 20° C. to 220° C., as measured by differential scanning calorimetry (DSC).

TABLE 3

| | Number-average particle diameter (nm) | SF2 | THF-insoluble matter in resin (%) |
|---|---|---|---|
| Organic fine particles 1 | 150 | 100 | 100 |
| Organic fine particles 2 | 290 | 100 | 99 |

TABLE 4

| | Number-average particle diameter (nm) | SF2 |
|---|---|---|
| Inorganic fine particles 1 (colloidal silica) | 100 | 100 |

<Production Example for Toner 1>

| | |
|---|---|
| Polyester resin 1: | 100 parts |
| Organic-inorganic composite fine particles 1: | 10 parts |

-continued

| | |
|---|---|
| Magnetic iron oxide particles: | 75 parts |
| Fischer-Tropsch wax (produced by Sasol, C105, melting point: 105° C.): | 1 part |
| Charge control agent (produced by Hodogaya Chemical Industries Co., Ltd., T-77): | 2 parts |

The above materials were pre-mixed by a Henschel mixer, and then melt-kneaded by using PCM-30 (manufactured by Ikegai Corp.) whose temperature was set so that the temperature of a melt at a discharge port was 150° C. The resulting kneaded product was cooled and coarsely ground by a hammer mill, and thereafter finely ground using Turbo Mill T250 (manufactured by Turbo Kogyo, Co., Ltd.) as a grinding machine. The resulting powder finely ground was subjected to classification using a multi-fraction classifier utilizing a Coanda effect, thereby providing toner particles having a weight-average particle diameter (D4) of 6.8 μm.

Subsequently, 1.0 part of fumed silica (BET: 200 $m^2/g$) was externally added to 100 parts of toner particles with mixing using a Henschel mixer for sieving by a mesh having an aperture of 150 μm, thereby providing toner 1. The softening point Tm and the weight-average particle diameter (D4) of toner 1 are shown in Table 5.

<Production Examples for Toners 2 to 8 and Comparative Toners 1 to 8>

The toners 2 to 8 and comparative toners 1 to 8 were produced in the same manner as in toner 1 except that the binder resin, the organic-inorganic composite fine particles, the organic fine particles and the inorganic fine particles for use were changed as shown in Table 5. The softening point Tm and the weight-average particle diameter (D4) of each of toners 2 to 8 and comparative toners 1 to 8 obtained are shown in Table 5.

TABLE 5

| | Binder resin | Organic-inorganic composite fine particles/ organic fine particles/ inorganic fine particles | Amount added (parts) | Toner Tm (° C.) | Weight-average particle diameter (D4) (μm) |
|---|---|---|---|---|---|
| Toner 1 | Polyester resin 1 | Organic-inorganic composite fine particles 1 | 10 | 131 | 6.8 |
| Toner 2 | Polyester resin 1 | Organic-inorganic composite fine particles 2 | 10 | 128 | 6.7 |
| Toner 3 | Polyester resin 1 | Organic-inorganic composite fine particles 3 | 10 | 135 | 6.8 |
| Toner 4 | Polyester resin 1 | Organic-inorganic composite fine particles 4 | 10 | 128 | 6.7 |
| Toner 5 | Polyester resin 1 | Organic-inorganic composite fine particles 5 | 10 | 134 | 6.9 |
| Toner 6 | Polyester resin 2 | Organic-inorganic composite fine particles 1 | 10 | 120 | 6.8 |

TABLE 5-continued

| | Binder resin | Organic-inorganic composite fine particles/ organic fine particles/ inorganic fine particles | Amount added (parts) | Toner Tm (° C.) | Weight-average particle diameter (D4) (μm) |
|---|---|---|---|---|---|
| Toner 7 | Polyester resin 3 | Organic-inorganic composite fine particles 1 | 10 | 113 | 6.8 |
| Toner 8 | Polyester resin 1 | Organic-inorganic composite fine particles 8 | 10 | 137 | 6.8 |
| Comparative toner 1 | Polyester resin 1 | Inorganic fine particles 1 | 10 | 120 | 6.8 |
| Comparative toner 2 | Polyester resin 1 | Organic fine particles 1 | 10 | 119 | 6.7 |
| Comparative toner 3 | Polyester resin 1 | Organic fine particles 2 | 10 | 120 | 6.9 |
| Comparative toner 4 | Polyester resin 1 | Organic-inorganic composite fine particles 6 | 10 | 124 | 6.8 |
| Comparative toner 5 | Polyester resin 1 | Organic-inorganic composite fine particles 7 | 10 | 123 | 6.7 |
| Comparative toner 6 | Polyester resin 1 | — | — | 120 | 6.9 |
| Comparative toner 7 | Polyester resin 2 | — | — | 114 | 6.8 |
| Comparative toner 8 | Polyester resin 3 | — | — | 106 | 6.7 |

Example 1

The machine for use in evaluation in the present Example was a commercially available printer HP LaserJet Enterprise 600 M603dn (manufactured by Hewlett-Packard Development Company, L.P.: process speed: 350 mm/s) using a magnetic one-component developer. Toner 1 was used for performing the following evaluations in the evaluation machine.

(Evaluation of Developability)

The toner was loaded to a predetermined process cartridge. Paper (81.4 g/m$^2$) was used to perform an imaging test for 1,000 sheets in total in a mode set so that two sheets per job were subjected to imaging of a lateral image pattern in which the coverage rate was 2%, and the machine was once stopped between jobs and then the next job was started, thereby measuring the image density. The evaluation was performed under an ordinary temperature and ordinary humidity environment (25.0° C., 60% RH). The image density was measured by measuring the reflection density of a solid image of a round of 5 mm using a reflection densitometer, Macbeth Densitometer (manufactured by Macbeth) with an SPI filter. The evaluation results are shown in Table 6.

(Evaluation of End-Portion Hot Offset Resistance)

In order to set evaluation conditions so as to make the occurrence of end-portion hot offset easy, the process speed of a printer was altered from 350 mm/s to 150 mm/s. Paper (66 g/m$^2$) was used. A lateral line pattern in which the coverage rate was 2% was output on A5-size paper for 500 sheets, and then a lateral line pattern in which the coverage rate was 2% was continuously output on A4-size paper for 100 sheets. How many sheets end-portion offset occurred on the end portion of A4-size paper was visually observed, and rated according to the following criteria. The end-portion offset is superior as end-portion offset disappeared for a smaller number of sheets. The evaluation was performed under an ordinary temperature and ordinary humidity environment (25.0° C., 60% RH). The evaluation results are shown in Table 6.

(Evaluation of Low-Temperature Fixability)

A fixing apparatus was altered so that the fixing temperature thereof could be arbitrarily set. The preset temperature of a fixing unit is regulated in a range of 170° C. or higher and 220° C. or lower at intervals of 5° C., and a halftone image is output on paper (81.4 g/m$^2$) so that the image density was in a range from 0.60 to 0.65. The resulting image was rubbed with lens-cleaning paper under a load of 4.9 kPa backward and forward five times, and the rate of decrease in density was measured before and after rubbing. The relationship between the fixing temperature and the rate of decrease in density was used for rating, and the preset temperature at which the rate of decrease in density was the most close to 10% was defined as the fixing temperature. It is meant that the low-temperature fixability is superior as the fixing temperature is lower. The evaluation was performed under an ordinary temperature and ordinary humidity environment (25.0° C., 60% RH). The evaluation results are shown in Table 6.

Examples 2 to 8, and Comparative Examples 1 to 8

The same evaluation as in Example 1 was performed using each of toners 2 to 8, and comparative toners 1 to 8. The evaluation results are shown in Table 6.

TABLE 6

| | Toner | End-portion hot offset | Low-temperature fixability (° C.) | Developability under ordinary temperature and ordinary humidity environment |
|---|---|---|---|---|
| Example 1 | Toner 1 | No occurrence | 200 | 1.42 |
| Example 2 | Toner 2 | Disappeared on 2$^{nd}$ sheet | 200 | 1.41 |
| Example 3 | Toner 3 | No occurrence | 200 | 1.43 |
| Example 4 | Toner 4 | Disappeared on 3$^{rd}$ sheet | 200 | 1.40 |
| Example 5 | Toner 5 | No occurrence | 200 | 1.42 |
| Example 6 | Toner 6 | Disappeared on 8$^{th}$ sheet | 195 | 1.40 |
| Example 7 | Toner 7 | Disappeared on 12$^{th}$ sheet | 190 | 1.40 |
| Example 8 | Toner 8 | No occurrence | 200 | 1.41 |
| Comparative Example 1 | Comparative toner 1 | Disappeared on 10$^{th}$ sheet | 200 | 1.40 |
| Comparative Example 2 | Comparative toner 2 | Disappeared on 11$^{th}$ sheet | 200 | 1.41 |

TABLE 6-continued

| | Toner | End-portion hot offset | Low-temperature fixability (° C.) | Developability under ordinary temperature and ordinary humidity environment |
|---|---|---|---|---|
| Comparative Example 3 | Comparative toner 3 | Disappeared on $10^{th}$ sheet | 200 | 1.40 |
| Comparative Example 4 | Comparative toner 4 | Disappeared on $7^{th}$ sheet | 200 | 1.39 |
| Comparative Example 5 | Comparative toner 5 | Disappeared on $7^{th}$ sheet | 200 | 1.40 |
| Comparative Example 6 | Comparative toner 6 | Disappeared on $9^{th}$ sheet | 200 | 1.39 |
| Comparative Example 7 | Comparative toner 7 | Disappeared on $12^{th}$ sheet | 195 | 1.38 |
| Comparative Example 8 | Comparative toner 8 | Disappeared on $18^{th}$ sheet | 190 | 1.38 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-158908, filed Jul. 31, 2013, which is hereby incorporated by reference herein in its entirety.

What is claimed is:

1. A toner comprising toner particles and an external additive, wherein:

each of the toner particles contains:

a binder resin, and organic-inorganic composite fine particles each of which contains a resin particle and inorganic fine particles, the organic-inorganic composite fine particles being dispersed in the binder resin, and the organic-inorganic composite fine particles (1) have a number-average particle diameter of 70 nm or more and 500 nm or less, (2) have a structure of which the inorganic fine particles are embedded in the resin particle, and have convexes derived from the inorganic fine particles on surfaces of the respective organic-inorganic composite fine particles, (3) have a shape factor SF-2 of 103 or more and 120 or less, and (4) contain a resin component in which a proportion of THF-insoluble matter based on a mass of the resin component is 95% by mass or more.

2. The toner according to claim 1, wherein the inorganic fine particles in the organic-inorganic composite fine particles are silica fine particles or metal oxide fine particles.

* * * * *